US006217632B1

(12) United States Patent
Megy

(10) Patent No.: US 6,217,632 B1
(45) **Date of Patent: *Apr. 17, 2001**

(54) MOLTEN ALUMINUM TREATMENT

(76) Inventor: Joseph A. Megy, 347 Birch St., Imperial, PA (US) 15126

( * ) Notice: Subject to any disclaimer, the term of this patent is extended or adjusted under 35 U.S.C. 154(b) by 0 days.

This patent is subject to a terminal disclaimer.

(21) Appl. No.: 09/340,529

(22) Filed: Jun. 28, 1999

Related U.S. Application Data

(63) Continuation-in-part of application No. 09/089,640, filed on Jun. 3, 1998, now Pat. No. 5,935,295.

(51) Int. Cl.[7] ..... C22C 1/02

(52) U.S. Cl. ..... 75/680; 164/55.1; 164/473; 420/590

(58) Field of Search ..... 75/680; 164/473, 164/55.1; 420/590

(56) References Cited

U.S. PATENT DOCUMENTS 5,055,256 10/1991 Sigworth et al. ..... 420/548
5,935,295 * 8/1999 Megy ..... 75/680

* cited by examiner

*Primary Examiner*—Melvyn Andrews
(74) *Attorney, Agent, or Firm*—Andrew Alexander

(57) ABSTRACT

A method of grain refining aluminum, the method comprising providing a molten aluminum body containing at least one of the metals selected from the group consisting of titanium, zirconium, vanadium, molybdenum, manganese, silicon, tungsten, tantalum, niobium and beryllium. A material reactive with the titanium is introduced preferably in gaseous form to the aluminum body. The material has a component selected from the group consisting of boron, carbon, sulfur, nitrogen and phosphorus. The material and said metal form a grain refining compound adapted for grain refining the aluminum.

47 Claims, 2 Drawing Sheets

METAL TREATMENT

MOLTEN ALUMINUM TREATMENT

CROSS REFERENCE TO RELATED APPLICATION

This application is a continuation-in-part of U.S. Ser. No. 09/089,640, filed Jun. 3, 1998 now U.S. Pat. No. 5,935,295.

BACKGROUND OF THE INVENTION

This invention relates to molten aluminum treatments and more particularly it relates to molten metal treatment for degassing and/or forming grain refining nuclei in molten aluminum in situ.

There is an ever increasing effort to improve aluminum and its alloys by the use of new grain refiners or master alloys comprising the grain refiners. Presently, the most popular grain refiners for aluminum utilize titanium diboride ($TiB_2$) type compound [$(TiAl)B_2$] or titanium carbide (TiC). Typically, the $TiB_2$ is produced by reacting $K_2TiF_6$ and $KFB_4$ salts with aluminum to produce the master alloy with excess titanium. The master alloy is added to the molten aluminum to be refined prior to the casting operation and usually prior to filtration. This master alloy manufacturing process produces small particle sized $TiB_2$ and $TiAl_3$, entrained KAlF and $Al_2O_3$. Sometimes the salts are added directly to the molten metal to be refined. When the master alloy is used, it is added to the melt as a waffle or rod.

However, the use of master alloys or addition of the salts directly to the metal is not without problems. For example, the master alloys containing $TiB_2$ often have salt and oxide inclusions, e.g., titanium and boron salts and aluminum oxides. Often the inclusions are larger than the $TiB_2$ particles. Further, the master alloy also can contain $TiB_2$ clusters or large $TiB_2$ particles which, of course, again are larger than the individual $TiB_2$ particles. The $TiB_2$ clusters normally contain materials such as oxides and salts, e.g., $KAlF_4$. The inclusions and clusters are detrimental because they are frequently the source of downstream processing problems in the cast or fabricated aluminum product. For example, the inclusions and clusters cause increased wear on cutting, rolling or die surfaces used to process the cast aluminum product. The inclusions and clusters are a source of defects such as holes and stress points in the metal. Further, the inclusions and clusters are detrimental because of filter clogging just prior to the casting operation, adding an additional expense in filter replacement.

Another very effective grain refiner that is being increasingly used with aluminum is Al-3% Ti-0.15C. Master alloys containing TiC are often prepared by heating mixtures of aluminum, titanium and carbon. However, this method has the problem that the process temperature is quite high, e.g., 1200° to 1300° C. Further, the process only makes a dilute master alloy, i.e. a master alloy that is dilute in grain refining nuclei, e.g., Al-3% Ti-0.15C. With this grain refining system, there are problems with purity resulting from oxide inclusions and carbon cores.

In addition, the use of master alloys has the problem that they provide localized, high concentrations of refiner which can result in larger clusters of particles, residual slag ($KAlF_4$), oxides, etc., and inoperative nuclei as well as problems dispersing the particles and dissolving the aluminides. Even though master alloys are presently used throughout the industry, they are an inefficient use of the refiner components. The high concentrations of refiner referred to are even more pronounced in foundry situations where cast waffles of master alloys are added to the aluminum melt.

The use of the term "aluminum" as used herein is meant to include aluminum and its alloys.

Prior attempts at improving grain refining have focused on improving the master alloy. For example U.S. Pat. No. 5,415,708 discloses an aluminum base alloy consisting essentially of from 0.1 to 3.0% boron, from 1 to 10% titanium and the balance essentially aluminum wherein the aluminum matrix contains $TiB_2$ particles dispersed throughout said matrix having an average particle size of less than 1 micron, and wherein the matrix contains clusters of said $TiB_2$ particles greater than 10 microns in size with an average of less than 4 of said clusters per 2 $cm^2$. The alloy is prepared by adding a boron containing material selected from the group consisting of borax, boron oxide, boric acid and mixtures thereof, and $K_2TiF_6$ to a bath of molten aluminum and stirring the molten mixture.

U.S. Pat. No. 5,100,618 discloses a process for producing aluminum grain refiner, such as Al—Ti—B grain refiner. Molten aluminum is continuously flowed as a bottom layer along a substantially horizontal or slightly inclined trough. Titanium or boron compounds reducible by aluminum or a mixture of such compounds is added to the surface of the aluminum layer such that a discrete separate layer of these is formed on top of the aluminum layer. Reaction between the aluminum and the titanium and/or boron compounds occurs along the interface between the layers and this reaction may, if desired, be aided by providing relative movement between the layer of molten aluminum and the layer of titanium and/or boron compounds.

U.S. Pat. No. 5,104,616 discloses a method for the production of master alloys intended for grain refining of aluminum melts and being of the type which comprises of aluminum and 1–15 percent by weight titanium, where titanium is present in the form of intermetallic crystals of titanium aluminide in combination with additives of carbon and/or nitrogen. The method is characterized by adding carbon and/or nitrogen to the aluminum melt in an amount corresponding to at least 0.01 percent by weight in the resultant solidified material. The addition of the carbon and/or nitrogen is effected in elemental form or in the form of dissociable carbon and/or nitrogen containing compounds, making said addition before or during an established thermodynamic state of dissolution of existing crystals of titanium aluminide, and bringing the melt into a thermodynamic state where crystals of titanium aluminide present grow in size and thereafter causing the melt to solidify.

U.S. Pat. No. 3,961,995 discloses an aluminum-titanium-boron mother alloy having a boron content of 0.2 to 0.8% by weight and a titanium content such that Ti—2.2 B≧3.9%, in which the matrix has a preponderant proportion of grains of less than 30 microns in size, and contains fine $TiB_2$ crystals having an average size of about 1 micron primarily dispersed along the grain boundaries, and the method for the preparation of same by the formation of titanium diboride by the action of liquid aluminum on titanium oxide and boron oxide in solution in molten cryolite, mixing the reactants in a manner to utilize the starting materials, and then quenching the formed alloy rapidly to cool and solidify the mother alloy, preferably by pouring the liquid alloy in water to produce the alloy in the form of granules or fine powder.

U.S. Pat. No. 4,803,372 discloses a process for producing a composite comprising a refractory material dispersed in a solid matrix. A molten composition comprising a matrix liquid, and at least one refractory carbide-forming component are provided, and a gas is introduced into the molten composition. A reactive component is also provided for reaction with the refractory material-forming component. The refractory material-forming component and reactive component react to form a refractory material dispersed in the matrix liquid, and the liquid composite is cooled to form a solid composite material.

British Patent 1,333,957 discloses a method of preparing a master alloy intended to be added to an aluminum melt to control the grain size during solidification thereof, which comprises providing a master alloy melt containing aluminum together with 0.02 to 6% by weight of titanium and 0.01 to 2% by weight of boron and holding the master alloy melt at a temperature between its melting point and 900° C. under agitation for a period of at least 15 minutes and at most 9 hours.

U.S. Pat. No. 5,100,488 discloses an improved aluminum-titanium master alloy which contains in weight percent, carbon about 0.005 up to 0.05 titanium 2 to 15, and the balance aluminum. After melting, the master alloy is superheated to about 1200° C.–1300° C. to put the element into solution, then the alloy is cast in a workable form. The master alloy in final form is substantially free of carbides, sulfides, phosphides, nitrides, or borides greater than about 5 microns in diameter. The alloy of this invention is used to refine aluminum products that may be rolled into thin sheet, foil, or fine wire and the like. Such grain refined products are also substantially free of carbides, sulfides, phosphides, nitrides or borides.

U.S. Pat. Nos. 5,041,263 and 4,812,290 disclose an improved aluminum-titanium master alloy containing carbon in an amount not more than about 0.1%. After melting, the master alloy is superheated to about 1200° C.–1250° C. to put the carbon into solution, then the alloy is cast in a workable form. The master alloy in final form is substantially free of carbides greater than about 5 microns in diameter. The alloy of this invention is used to refine aluminum products that may be rolled into thin sheet, foil, or fine wire and the like.

U.S. Pat. No. 4,556,419 discloses hydrogen gas and non-metallic inclusions removed from molten aluminum by a process comprising the steps of maintaining an atmosphere containing $BF_3$ gas in a treating vessel above the surface of molten aluminum placed therein, introducing a treating gas into the molten aluminum, and removing floating non-metallic inclusions and treating gas containing hydrogen gas from the surface of the molten aluminum.

U.S. Pat. No. 4,873,054 discloses an improved aluminum-titanium master alloy. Such alloy contains a small but effective amount of, in weight percent, any two or more elements selected from the group consisting of carbon about 0.003 up to 0.1, sulfur about 0.03 up to 2, phosphorus about 0.03 up to 2, nitrogen about 0.03 up to 2, and boron about 0.01 up to 0.4, titanium 2 to 15, and the balance aluminum.

U.S. Pat. Nos. 4,842,821 and 4,748,001 disclose a method of producing an alloy containing titanium carbide particles, the method comprising thoroughly dispersing carbon powder particles into a metal melt, and causing the dispersed carbon particles to react with titanium within the metal melt so as to produce a dispersion of fine particles comprising titanium carbide within the melt. A preferred use for alloys produced by the invention is as a grain refiner for aluminum-based metals, especially those containing zirconium, chromium and/or manganese, which tend to poison current titanium-boron-aluminum grain refiners.

U.S. Pat. No. 4,392,888 discloses molten aluminum or other metals purified by contacting with a fluorocarbon, such as $CCl_2F_2$, in order to decrease the amount of impurity metal elements along with gas and inclusions therein preferably in the presence of an agitator to enhance efficiency. An oxidizer, such as oxygen, is employed to prevent the carbon in the fluorocarbon from forming carbide inclusions. Oxidizing the carbon to carbon monoxide is preferred in treating aluminum since the monoxide effectively removes the carbon from the system without oxidizing aluminum.

German Patent 1,027,407 discloses a process for grain refining aluminum alloys, especially magnesium containing alloys which contain boron and/or titanium characterized by the fact that carbon is produced in finely divided form by decomposing carbon compounds, e.g., carbon tetrachloride, which are introduced to the melt in a carrier gas to promote formation of carbides as crystallization nuclei. The patent states that the carbon tetrachloride is not dangerous to foundry personnel because its vapor will decompose at normal casting temperatures.

U.S. Pat. No. 4,402,741 discloses a process and an apparatus for the precise and continuous injection of a halogenated derivative, which is liquid at ambient temperature, into a liquid metal such as aluminum and aluminum-based alloys. The process involves withdrawing the halogenated substance from a tank, introducing it by means of a metering pump into a vaporizer which has been brought to a temperature at least equal to the vaporization temperature of the substance under the injection pressure, and entraining it in the vapor state by an inert gas stream towards an injection means opening into the center of the liquid metal.

In spite of these disclosures there is still a great need for improvements in grain refining of aluminum which do not contaminate the metal and which permit grain refining at molten aluminum processing temperatures. The present invention provides such an improvement.

SUMMARY OF THE INVENTION

It is an object of the invention to provide an improved process for treating molten aluminum to improve structural characteristics of products cast therefrom.

It is another object of the invention to provide a combination of molten metal treatment, e.g., degassing, and forming grain refining nuclei.

Yet, it is a further object of the invention to provide improved grain refining of aluminum without the use of master alloys.

And, it is another object of the invention to provide a process for improved grain refining of aluminum.

It is yet another object of the invention to provide an improved grain refining nuclei for aluminum, i.e., smaller, more uniform size, cleaner, better dispersed and more efficient.

It is still another object of the invention to provide a titanium based grain refining nuclei for aluminum.

And, it is still another object of the invention to provide a process for in situ development of grain refining nuclei for aluminum at molten aluminum treatment temperatures without the use of master alloys.

And yet, it is another object of the invention to grain refine aluminum by producing very fine, uniform particle sized grain refiner in situ prior to casting.

Still yet, it is another object of the invention to provide an improved aluminum alloy substantially free of clusters and oxides and having controlled size grain refiner particles and grains in the solidified aluminum.

And still yet, it is another object of the invention to provide an improved process for molten aluminum treatment having improved filter life.

And yet still, it is another object of the invention to provide a grain refining nuclei for aluminum which is in thermodynamic equilibrium with the molten aluminum and aluminum alloys.

Still, it is another object of the invention to provide a nascently formed, effective nuclei for refining aluminum and its alloys.

Other objects of the invention will become apparent from the specification and claims appended hereto.

In accordance with these objects there is provided a method of molten metal treatment wherein the molten metal is treated to remove impurities and is provided with grain refining nuclei in situ. The method comprises providing a molten aluminum body containing 1 to 3000 ppm titanium, preferably 1 to 1500 ppm. A material reactive with the titanium is introduced to the aluminum body. At least one metal selected from the group consisting of zirconium, vanadium, manganese, molybdenum, tungsten, tantalum, niobium and beryllium or mixtures thereof may be added or provided in the body of molten aluminum with titanium or instead of titanium. The material reactive with titanium or the metal from the group is preferably in gaseous from. The reactive material has at least one component thereof that is comprised of at least one of the group consisting of boron, carbon, sulfur, nitrogen and phosphorus. The reactive material and said metal from the group form a grain refining compound which is insoluble in molten aluminum and is adapted for grain refining the aluminum as it proceeds to the casting operation.

DETAILED DESCRIPTION OF THE PREFERRED EMBODIMENTS

In one embodiments of the invention, a body of molten aluminum is grain refined by providing in the body a controlled level of at least one of titanium, zirconium, vanadium, molybdenum, manganese, tungsten, tantalum, niobium and beryllium or mixtures thereof and adding to the molten aluminum a compound or material which forms small, discrete compounds such as TiC, $TiB_2$, ZrC or $ZrB_2$ or the like that provide nucleation sites for grain refining aluminum. The discrete compounds as well as containing, for example, TiC, $TiB_2$, ZrC or $ZrB_2$, can contain other metals such as the metals enumerated, e.g., titanium, zirconium, vanadium, manganese, molybdenum, tungsten, tantalum, niobium and beryllium, or mixtures thereof, including aluminum. For example, if the molten aluminum contains about 150 ppm vanadium, then the nuclei can contain 15% vanadium. That is, the vanadium co-precipitates in the $TiB_2$ to provide a nuclei containing, in addition to titanium, about 15% vanadium. If the aluminum alloy contains manganese, e.g., 1 wt. %, then it will be found that the nuclei can contain 25% manganese. Further, silicon and iron when present can also form part of the nuclei.

Another important feature of the present invention includes the temperature range used for developing the grain refining nuclei. That is, preferably graining nuclei are developed in a temperature range of about 1220° to 1400° F. for molten aluminum. This range is important because at increasing temperatures, the grain refining nuclei become more soluble.

Figure 1:
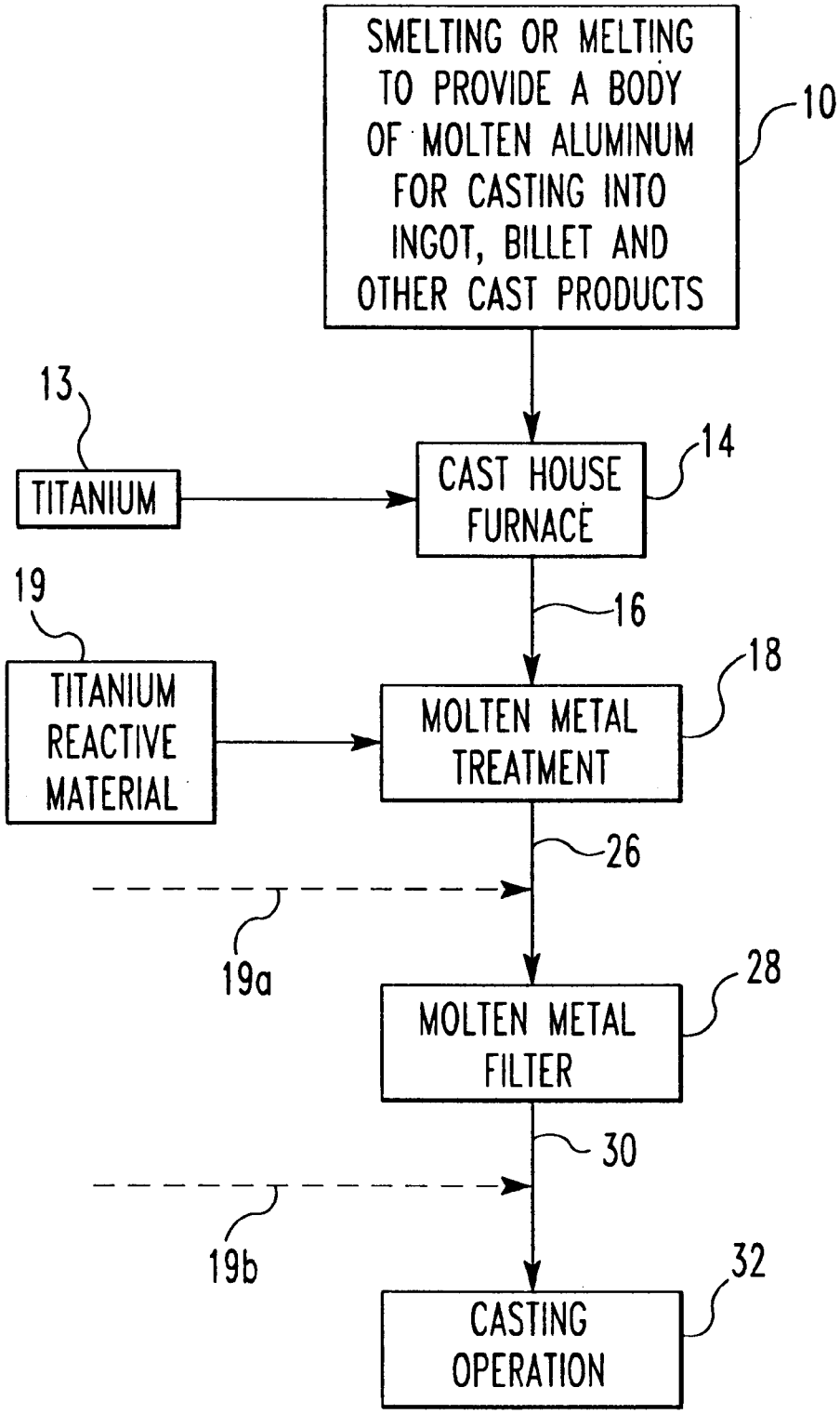
FIG. 1 is a schematic illustration of steps in treating a body of molten aluminum showing addition of grain refining materials in accordance with the invention.

Referring now to FIG. 1, there are shown steps for processing and grain refining an aluminum body in accordance with the invention to both purify and grain refine the molten aluminum as it is directed from the smelting or melting to the casting operation. In FIG. 1, there is shown a body of aluminum, referred to as 10. Molten aluminum is drawn from body 10 along line 12 to a cast house furnace 14 where metal is contained prior to casting. For purposes of casting, molten metal is withdrawn from furnace 14 along line 16 to a metal treatment step 18. In the metal treatment step typically a fluxing gas is dispersed therein. The fluxing gas removes both dissolved and suspended solid impurities, including oxides, nitride carbide and carbonates of the molten metal and alloying elements. The impurities include both dissolved gases and dissolved elements. Dissolved gases in molten aluminum, for example, include hydrogen and dissolved elements include alkali and alkaline elements such as sodium and calcium. Suspended solid impurities are transported to the melt surface by attachment to rising bubbles of the fluxing gas. Hydrogen is desorped into the gas bubbles for removal.

The fluxing gases that can be used for molten aluminum include nitrogen containing gases, halogen gases and the so-called inert gases, namely, helium, neon, argon, krypton, and xenon along with nitrogen, carbon dioxide and mixtures of these gases. In addition, chlorine and sulfur hexafluoride may be used, typically in combination with the inert gas. Small amounts of chlorine or fluorine gases or other halides or mixtures thereof such as $BCl_3$, $BF_3$, $BFCl_2$, $BBr_3$, $BI_3$, $PCl_5$ and $SOCl_2$ can assist in removing suspended solids and dissolved elements.

Figure 2:
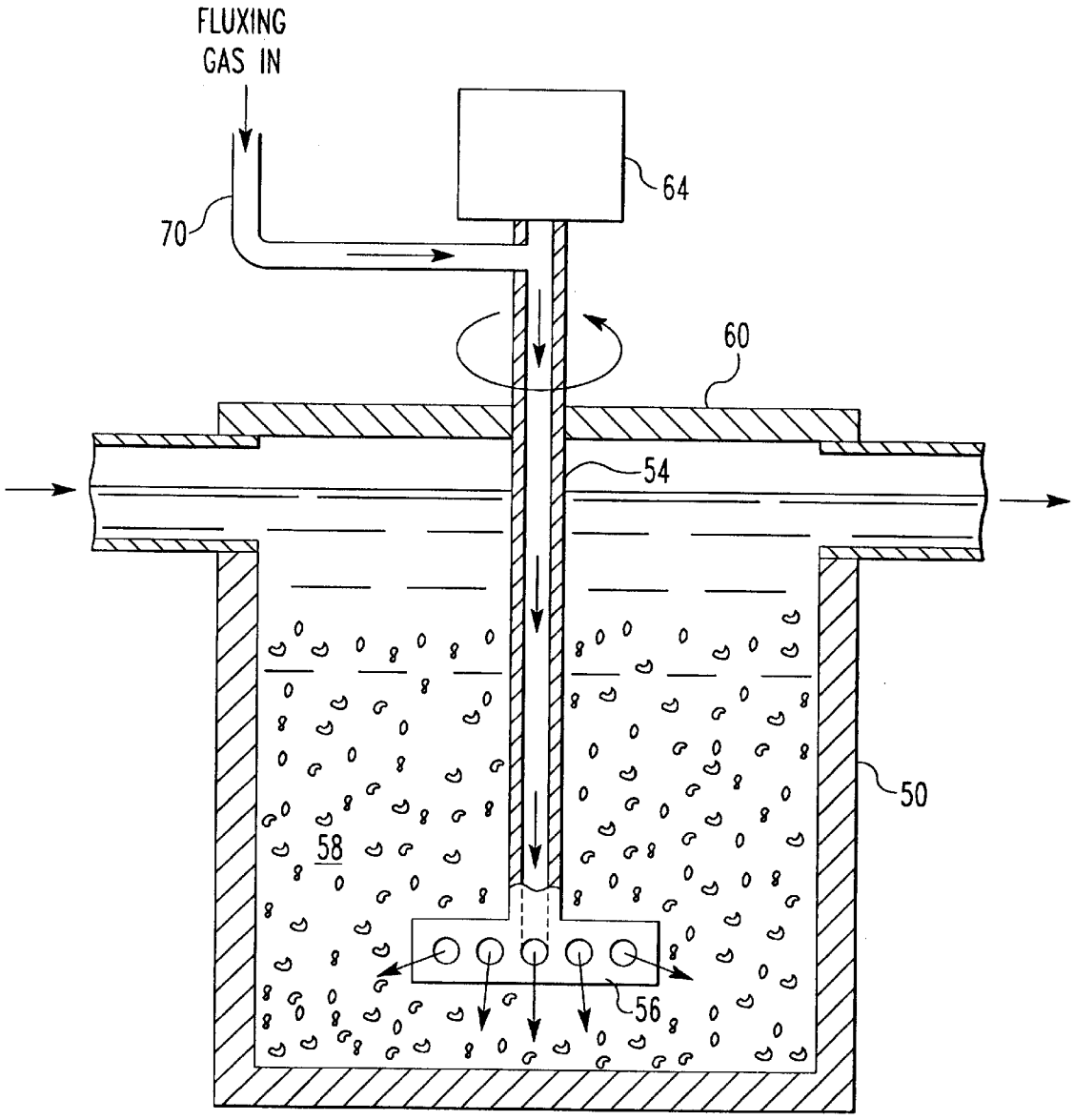
FIG. 2 is a cross-sectional view of a metal treatment bay for fluxing molten aluminum.

With respect to molten metal treatment, there is shown in FIG. 2 a schematic view of a metal treatment or gas fluxing bay 50 having a hollow shaft 54 and impeller or gas disperser 56 located in a body of molten metal, e.g., aluminum 58. Shaft 54 is carried by structure 60. Further, shaft 54 is rotated by motor 64. The rotation can be unidirectional or bidirectional. Fluxing or carrier gas is added through tube 70 and down hollow shaft 54 before being dispersed through tubes or conduits in impeller 56. Instead of passing fluxing gas down hollow shaft 54, the gas may be added through a tube or other means and dispersed by impeller 56. Alternatively, the gas may be injected adjacent to the impeller for dispersion purposes. Also, diffusers may be used to introduce the gas and distribution may be assisted by the rotating impeller.

After the metal treatment step, molten metal is conveyed along line 26 through filter 28 which removes particles detrimental to the processing of the cast product. After filtration, the molten metal is removed along line 30 to casting facility 32 where the molten metal is cast into billet, ingot or stab, for example.

For purposes of the present invention, preferably the molten aluminum in cast house furnace 14 is maintained at a temperature in the range of 1200° to 1500° F. or higher, if desired. Higher temperatures can be used for the molten metal treatment process shown in FIG. 1 but are not currently believed necessary for purposes of the present invention. Normally, higher temperatures are undesirable not only because of the extra cost but also be cause there is a greater tendency to form oxides, pick up hydrogen, degrade refractories, etc.

In accordance with the present invention, a source of titanium 13 (or other metals such as niobium, tungsten, tantalum, manganese, vanadium, molybdenum, silicon, zirconium and beryllium and mixtures thereof with or without tantalum) is added to the aluminum melt typically in furnace 14 or during metal treatment step 18. It should be noted that the titanium or other metals can be added anywhere in the process shown in FIG. 1 as long as it is added concurrently or prior to the addition of the titanium reactive material or material reactive with the other metals. Preferably, the titanium or other metals are added in the furnace as shown in FIG. 1. The process is described herein mostly with respect to titanium for simplicity, but the procedure also applies to the other metals. The amount of titanium added is that sufficient to provide for grain refining of the aluminum body. The amount of titanium that is effective form grain refining in the present invention can range from about 1 ppm to about 3000 ppm, with a preferred amount ranging from 20 to 1500 ppm and typically an amount ranging from 40 to less than 1000 ppm, e.g., 40 to 950 ppm, typically 40 to 600 ppm. Higher amounts of titanium can be used but care is required to avoid exceeding the solubility limit of titanium in molten aluminum or the formation of substantial amounts of titanium aluminide ($TiAl_3$) particles in the melt. Titanium aluminide forms large particles which are detrimental in processing or working the cast product. Other metals, as noted, can be added in the range of 1 to 500 ppm to provide a more effective nuclei or may be added in larger quantities to produce aluminum alloys.

Titanium 13 can be added to the molten aluminum as titanium metal, metal alloy or master alloy. In another aspect of the invention, the titanium may be added to the molten aluminum as a titanium compound that is reduced by the molten aluminum. Such compounds can include $TiCl_4$, $K_2TiF_6$ or $Na_2TiF_6$, for example. Or, the titanium can be added to the molten aluminum as compacts, waffles or swarfs, Typically, waffles have a composition comprising 5 to 10 wt. % or more of titanium. For example, waffles typically comprise 6 to 10 wt. % titanium, the remainder aluminum. Compacts by comparison usually comprised 80 wt. % or greater titanium. The compacts are comprised of particles having a large surface area, and such compacts can contain fluxing salts such as sodium chloride, potassium chloride, potassium aluminum fluoride, sodium fluoride, and potassium boron fluoride which aid in dissolution of the titanium in the melt and improves the integrity of the compact by holding the particles together. Other grain refining metals can be added in similar ways, either with the titanium or separately.

After titanium 13 has been added to the molten aluminum, a material or compound 19 is added to the melt which reacts with the titanium and/or the aluminum to form a titanium based grain refiner nuclei in situ. The material or compound which reacts with the titanium and/or aluminum is referred to as a reducible binary or titanium reactive material. For purposes of the invention, it will be appreciated that titanium reactive material 19 can be added with the titanium. However, as noted, it is preferred that titanium 13 is added before the addition of titanium reactive material 19. Adding the titanium first is effective in minimizing the reaction of titanium reactive material 19 with aluminum to form aluminum compounds such as, for example, aluminum carbide, aluminum boride, aluminum sulfide, aluminum phosphide or aluminum nitride, depending to some extent on the reactive material being added.

With reference to FIG. 1, it will be noted that titanium reactive material or compound 19 can be added during molten metal treatment step 18 or it can be added at 19*a* after metal treatment 18 but prior to molten metal filter step. In yet another embodiment, reactive compound 19 may be added at 19*b* after molten metal filter 28. That is, the present invention contemplates addition of the reactive material after the molten metal filter step and even in a tundish or pool or crater of molten metal in the ingot head just prior to solidification. Or, the reactive material can be added in a trough used to convey molten aluminum to the mold for casting purposes.

It is important to minimize the time between casting the molten aluminum and adding the titanium reactive material. That is, if the reactive material is added earlier, it can permit some settling of the grain refiner particles to occur. Thus, for purposes of the present invention, to minimize settling (sometimes referred to as fade) of the grain refiner, it is preferred to add the reactive material or compound as near the casting step as possible. In the present invention, the reactive material or compound is preferably added during the metal treatment step or following the filtration step. In the invention, it is advantageous to add the reactive material as close to solidification of the molten aluminum as possible so as to avoid grain growth or nuclei growth and to provide a nascent nuclei for grain refining.

In the present invention, the amount of titanium reactive material added is important. That is, it is preferred to add the titanium reactive material or compound at a level below its solubility limit in molten aluminum. If the solubility limit of the reactive material in molten aluminum is exceeded, then undesirable compound or precipitates form. Further, it is preferred that the titanium concentration is maintained stoichiometrically in excess of the reactive material or compound in the molten aluminum body. Thus, the molar ratio of titanium to reactive material in the melt is maintained such that there is an excess of titanium present in the active nuclei being formed, e.g., 0.5 molar for $TiB_2$ or 1.0 to TiC. The concentration and ratio depends to some extent on the titanium reactive material used. The other metals referred to, e.g., niobium, tungsten, tantalum, vanadium, molybdenum, zirconium and beryllium and mixtures thereof with or without titanium, are important to the invention in the preferred embodiments. That is, the other metals, e.g., vanadium, aid in depressing the solubility level of, for example, $TiB_2$, and thus aid in forming an insoluble grain refiner at lower concentrations of titanium and reactive material. For example, the presence of vanadium in the range of 50 to 500 ppm results in $TiB_2$ containing grain refining nuclei being more insoluble and thus, the melt or molten aluminum contain less dissolved titanium and reactive material. Thus, less titanium and reactive material are required for grain refining purposes.

Titanium reactive material suitable for grain refining in combination with titanium include compounds which will provide at least one of the following elements: boron, carbon, sulfur, phosphorus and nitrogen in the molten aluminum. It should be understood that any compound or material may be used which provides an element which in combination with titanium operates to provide grain refining nuclei in situ.

The reactive compound or material which operates with titanium or other metals to form active nuclei in situ for grain refining aluminum may either be solid, liquid or gaseous at the temperature of molten aluminum. For purposes of the invention it is preferred that the reactive compound is provided in gas form which facilitates addition of such reactive compounds particularly during the molten metal treatment step. By gaseous material or gaseous compound is meant a material or compound which is in finely divided or in gas form at molten aluminum temperature. Exemplary of reactive compounds that may be used in the invention include halide compounds such as chlorine, fluorine, bromine, or iodine, or mixed halides of boron, carbon, nitrogen, sulfur, and phosphorus. That is, reactive compounds of the invention can include chloride and fluoride compounds having a boron or carbon component. Preferably, the reactive chloride compounds include $BCl_3$, $CCl_4$, $C_2Cl_4$, $CHCl_3$, $NCl_3$ and $PCl_3$ and the reactive fluoride compounds include $SF_6$, $KBF_4$, $BF_3$ and $NF_3$. Hydrides such as boron hydrides or boranes may also be used. These materials may be provided in gas or aerosol form. For example, $KBF_4$ may be provided as a powder and added as an aerosol.

As noted, it is preferred that these compounds be introduced to the melt during the metal treatment step. Further, it will be appreciated that a single reactive compound may be used or a combination of compounds may be used, particularly if it is desired to provide both boron and carbon in the melt to form dispersion of $TiB_2$ and TiC for purposes of grain refining. With reference to FIG. 2, it will be seen that the reactive compound when in gaseous form is suitably added with the fluxing gas and dispersed efficiently through the melt, thus avoiding the localized, high concentration referred to earlier. If the reactive compound is in solid or liquid form, it may be atomized or volatized and added with the fluxing gas as shown in FIG. 2. For example, organic based liquids such as kerosene, carbon tetrachloride, vinyl chloride, polytetrafluoroethylene, butane, freon and ethylene chloride can be used by atomizing into small droplets using a ultrasonic nozzle. The droplets may be suspended in a sol and introduced to the gas stream. Or, the liquid may be vaporized into the gas stream.

If the titanium reactive material is provided in solid form it may be ground to a powder, e.g., powdered carbon, and introduced with the fluxing gas for dispersion therewith. Alternatively, solid titanium reactive compound may be added directly to the melt and dispersed with the impeller and/or fluxing gas.

It will be appreciated that the reactive compound may have a component such as hydrogen which is undesirable in the aluminum cast product. However, the hydrogen is effectively removed by the fluxing gas which is added concurrently or after the addition of the reactive compound, for example. As will be noted, the chlorine or fluorine components or other halide components or mixtures thereof of the titanium reactive material are not usually detrimental and thus do not present difficulties.

In the present invention, the amount of reactive compound added with or dispersed by the fluxing or carrier gas depends to some extent on the amount of titanium present in the melt and the extent of grain refining desired. Thus, the amount of reactive material is adjusted or added in accordance with the grain refining required.

Typically, the material reactive with titanium is provided in the fluxing gas in the range of 1 to 99 vol. % and preferably 2 to 50 vol. %, and typically 2 to 20 vol. %. The amount of reactive material added is that sufficient to form $TiB_2$ above its solubility limit in molten aluminum and produce insoluble graining nuclei. The material reactive with titanium can be added to provide at least one of the group consisting of boron, carbon, sulfur, nitrogen and phosphorus in the molten aluminum in the range of 0.01 to 400 ppm. For example, the boron containing reactive material is added to the fluxing or carrier gas to add boron in the range of 0.5 to 25 ppm, preferably 1 to 10 ppm, and typically in the range of about 2 to 5 ppm. When added in this way, the process is continuous, which in turn encourages production of a uniform nuclei size distribution.

By the use of the term "in situ" as used herein is meant to include or refer to aluminum in the normal operation or process of (1) smelting or melting, (2) treating molten aluminum for purification to remove dissolved and undissolved material, and (3) casting into, for example, ingot, billet, slab, or other cast products including foundry cast products. The use of the term "in situ" is not meant to include wire, rod, or ingot or the like of aluminum grain refiner alloys typically having high loading, e.g., 1 wt. %, of grain refiner and typically formed in an independent operation. The term nuclei or active nuclei as used herein, is meant to refer to compounds such as titanium diboride, titanium carbide or like compounds with or without at least one of the other metals selected from niobium, tungsten, tantalum, manganese, vanadium, molybdenum, silicon, zirconium and beryllium and mixtures thereof with or without titanium which operate to produce grain refined aluminum bodies on solidification.

It should be noted that titanium even in low concentrations, e.g., 50 ppm, reacts preferentially with the boron or carbon component, for example, of the reactive compound and minimizes reaction of the boron or carbon with aluminum.

As noted, the titanium and titanium reactive compound are preferably added to the melt below their solubility limits in pure aluminum with the titanium being in excess of the titanium reactive compound. The concentrations of the titanium and the reactive compounds are controlled to control the particle size of the grain refiner formed in the melt. To minimize the size of grain refining particles, the concentrations of both the titanium and reactive compounds preferably are maintained at low levels. For example, when the titanium is 100 ppm, the reactive component can be as follows: boron can be added in the range of 0.2 to 21 ppm; carbon can be added in the range of 0.2 to 23 ppm; sulfur can be added in the range of 0.6 to 63 ppm; phosphorus can be added in the range of 0.6 to 61 ppm; and nitrogen can be added in the range of 0.2 to 27 ppm. This can produce grain refiner particle sizes in the range of 0.1 to 1 $\mu$m and typically, 0.2 to 0.6 $\mu$m. It is believed that further dilution of the concentration, e.g., 10 ppm titanium to 0.1 to 1 ppm reactive component, may produce even smaller grain refiner particle sizes. All ranges set forth herein include all the numbers within the range as if specifically set forth.

If the source of titanium, or other metals, e.g., $TiCl_4$, MoCl, $VOCl_3$, is provided or added along with the reactive material, e.g., in the carrier or fluxing gas, preferably titanium and the reactive material are provided in a ratio which permits stoichiometric excess of titanium. This may be the situation where two gases are added to provide grain refiner in situ wherein the gases are mixed prior to addition or added to the melt separately. Also, the source of titanium and reactive material may be provided in amounts sufficiently dilute to favor formation of small particle size grain refiner compounds, e.g., TiC or $TiB_2$ in situ. In this way, only a limited amount of free titanium is available to react with the reactive material which results in small particle size grain refiner.

Typically, only small amounts (e.g., 0.2 to 5 ppm) of titanium reactive compound is required when added or produced by this method to provide well grain refined aluminum castings. The amount of inert or fluxing gas used to metal refine aluminum is many times greater on a molar basis than the titanium reactive compound. Therefore, the titanium reactive compound can be diluted with inert or fluxing gas as desired.

In another aspect of the invention, it should be understood that the titanium reactive material can be added after molten metal treatment step 18, and typically at 19*a* before molten metal filter 28 or at 19*b* after molten metal filter 28. That is, the titanium reactive material may be added as a substantially pure gas without dilution after the molten metal treatment step. Adding the reactive material after the molten treatment step operates to avoid loss of titanium reactive material or compounds or nuclei formed therefrom by removal in the fluxing gas, e.g., argon.

Even though the invention has been described as noted particularly with respect to titanium, it will be appreciated that other metals are contemplated within the purview of the invention, including but not limited to niobium, tungsten, manganese, silicon, tantalum, vanadium, molybdenum, zirconium and beryllium and mixtures thereof with or without titanium. The ranges set forth for titanium apply also to these metals as if specifically set forth.

The invention has the advantage that the grain refiner nuclei formed in situ has a composition which is essentially in thermodynamic equilibrium with the constituents comprising the melt. Further, as noted, the grain refiner nuclei can comprise a metal in addition to titanium such as niobium, tungsten, tantalum, vanadium, molybdenum, manganese, silicon, zirconium and beryllium and mixtures thereof. When the grain refiner nuclei comprises other components in addition to $TiB_2$, for example, such as vanadium, this has the advantage that it can serve to depress the solubility limit of the $TiB_2$ and thus less grain refiner components are dissolved in the melt. Also, the process for refining aluminum has the advantage that it is substantially flee from salts, e.g., fluoride salts and other inclusions which result from conventional grain refining techniques.

The invention can be used to produce improved grain refined aluminum alloy cast products comprised of aluminum, alloying elements and grain refiner nuclei. The grain refining process of the invention can be used with most aluminum alloys. The grain refiner is comprised of titanium or other metal selected from the group consisting of niobium, tungsten, tantalum, vanadium, manganese, silicon, molybdenum, zirconium and beryllium or mixtures thereof The grain refiner is further comprised of a material reactive with titanium, niobium, tungsten, tantalum, vanadium, manganese, silicon, molybdenum, zirconium and beryllium or mixtures thereof. The reactive material is comprised of at least one component selected from the group consisting of boron, carbon, sulfur, nitrogen and phosphorus. The grain refiner is present in the cast product as discrete particles having a particle size in the range of 0.05 to 2 $\mu$m. At least 70% of the grain refiner nuclei has a particle size in the range of 0.1 to 1 $\mu$m, preferably 0.1 to 0.5 $\mu$m. Typically, the grain refiner nuclei are present in the cast product in the range of $1\times10^7$ to $1\times10^{10}$ number of nuclei/cc, preferably $1\times10^8$ to $1\times10^9$ number of nuclei/cc of cast product. The nuclei have a spherical shape. The titanium based grain refiner nuclei can comprise 1 to 30% of at least one metal selected from niobium, tungsten, tantalum, vanadium, molybdenum, manganese, silicon, zirconium and beryllium or mixtures thereof

EXAMPLE 1

A high purity aluminum alloy was melted in a gas fired crucible furnace, and a small addition of titanium was made to the melt to provide the following composition:

| Fe | Si | Ti | Cu | Mn | V | B |
|---|---|---|---|---|---|---|
| 0.056 | 0.042 | 0.025 | 0.001 | 0.001 | 0.004 | 0.0001 |

A carbon lance was introduced to the crucible and argon was bubbled through the melt for 30 minutes to remove gas and any suspended inclusions. A conical sample was taken, according to test procedures established by the Aluminum Association (AA). The grain size was measured at a height of 1.5" from the bottom of the sample, according to procedures outlined in ASTM E112. The grain size (average intercept distance, or AID) was 3600 microns.

A gas mixture of argon-10% $BCl_3$ was then bubbled through the melt for a time, after which the boron concentration was found to be 0.0013% (or 13 ppm). The AA grain size was 210 microns.

EXAMPLE 2

In this example, the procedure was similar to Example 1, except that the metal had a starting composition of 0.59% Si and 0.005% Ti. The grain size before treatment was about 2000 microns.

A gas mixture of argon-10% $BCl_3$ was then bubbled through the melt, to produce a boron concentration of 0.0006% (6 ppm). The AA grain size was 225 microns.

EXAMPLE 3

In this example, the test procedure was the same as Example 2, except a gas mixture of argon-10% $BF_3$ was then bubbled through the melt, to produce a boron concentration of 0.0006% (6 ppm). The AA grain size was 250 microns.

It will be seen from the examples that aluminum is effectively grain refined using the process of the invention.

While the invention has been described in terms of preferred embodiments, the claims appended hereto are intended to encompass other embodiments which fall within the spirit of the invention.

What is claimed is:

1. An improved method for treating molten aluminum for solidifying into cast products wherein the molten aluminum is subject to a metal treatment, the improved method comprising forming grain refiner in the molten aluminum, the method comprising:

(a) providing a molten aluminum body;

(b) providing at least one metal selected from the group consisting of titanium, zirconium, vanadium, molybdenum, manganese, silicon, tungsten, tantalum, niobium and beryllium and mixtures thereof in said molten aluminum body;

(c) introducing to said molten aluminum body, a material reactive with at least one of said metals selected from the group consisting of titanium, zirconium, vanadium, molybdenum, manganese, silicon, tungsten, tantalum, niobium and beryllium, said material being in gaseous form at molten aluminum temperature and comprising at least one component of the group consisting of boron, carbon, sulfur, nitrogen and phosphorus, said material and at least one of said metal from said group forming grain refining nuclei in the aluminum body; and (d) solidifying at least a portion of said molten aluminum body into a grain refined, cast product.

2. The method in accordance with claim 1 including dispersing said material reactive with said metal from said group in said molten aluminum body using a carrier or fluxing gas.

3. The method in accordance with claim 1 including introducing said material reactive with said metal from said group in a carrier or fluxing gas.

4. The method in accordance with claim 3 including introducing said material reactive with metal from said group separate from said carrier or fluxing gas.

5. The method in accordance with claim 1 including maintaining said metal from said group in the range of 1 to 3000 ppm.

6. The method in accordance with claim 1 including maintaining said metal from said group in the range of 20 to less than 1500 ppm.

7. The method in accordance with claim 1 including maintaining said metal from said group in the range of 40 to 1000 ppm.

8. The method in accordance with claim 1 including maintaining said metal from said group in stoichiometric excess of said material reactive with said metal.

9. The method in accordance with claim 1 including providing said metal from said group in said aluminum body prior to adding said material reactive with said metal from said group.

10. The method in accordance with claim 1 including maintaining said body of molten aluminum in a temperature range of 1200° to 1500° F.

11. The method in accordance with claim 1 including selecting said material reactive with said metal from said group from at least one of the group consisting of $BCl_3$, $PCl_3$, $SF_6$, $KBF_4$, $BF_3$ and $NH_3$.

12. The method in accordance with claim 1 including selecting said material from the group consisting of at least one of a chloride or fluoride of boron and phosphorus.

13. The method in accordance with claim 1 including forming a grain refiner in said molten aluminum having a particle size in the range of 0.05 to 2 $\mu$m.

14. The method in accordance with claim 1 including maintaining said material reactive with said metal from said group in a carrier or fluxing gas in the amount of 1 to 50 vol. % of the carrier or fluxing gas.

15. The method in accordance with claim 1 including introducing said material reactive with said metal from said group in a gas selected from the group consisting of helium, neon, argon, krypton, xenon, nitrogen, sulfur hexafluoride, carbon dioxide and chlorine and mixtures thereof.

16. The method in accordance with claim 3 including introducing said material reactive with said metal from said group in said carrier or fluxing gas to provide at least one of the group consisting of boron, sulfur, nitrogen and phosphorus in the molten aluminum body in the range of 0.01 to 400 ppm.

17. An improved method for treating molten aluminum from solidifying into cast products wherein the molten aluminum is subject to a molten metal treatment, the method comprising:

(a) providing a molten aluminum body in a temperature range of 1200° to 1500° F.;

(b) providing at least one metal selected from the group consisting of titanium, zirconium, vanadium, molybdenum, manganese, silicon, tungsten, tantalum, niobium and beryllium and mixtures thereof in the range of 1 to 3000 ppm in said molten aluminum body;

(c) after providing said metal from said group in said body, introducing to said body a material reactive with at least one metal from said group, said material being in gaseous form at molten aluminum temperatures and being introduced to said body in a carrier gas or fluxing gas, said material selected from at least one of a chloride or fluoride of one of the groups consisting of boron, carbon, sulfur, nitrogen and phosphorus, said material and said metal from said group forming a grain refining nuclei in said molten aluminum body; and (d) solidifying at least a portion of said molten aluminum body into a grain refined, cast product.

18. The method in accordance with claim 17 including selecting said material from at least one of the group consisting of $BCl_3$, $PCl_3$, $SF_6$, $KBF_4$, $BF_3$ and $NH_3$.

19. The method in accordance with claim 17 including maintaining said metal from said group in the range of 20 to less than 1000 ppm.

20. The method in accordance with claim 17 including maintaining said metal from said group in the range of 20 to 600 ppm.

21. The method in accordance with claim 17 including forming a grain refiner in said molten aluminum having a particle size in the range of 0.1 to 2 $\mu$m.

22. The method in accordance with claim 17 including maintaining said metal from said group in stoichiometric excess of said material.

23. The method in accordance with claim 17 including maintaining said material reactive with said metal from said group in a carrier or fluxing gas in the amount of 1 to 50 vol. % of the carrier or fluxing gas.

24. The method in accordance with claim 17 including introducing said material reactive said metal from said group in a gas selected from the group consisting of helium, neon, argon, krypton, xenon, nitrogen, sulfur hexafluoride, carbon dioxide and chlorine and mixtures thereof.

25. In a continuous method of casting molten aluminum into solidified products wherein the molten aluminum is subject to a metal treatment prior to said casting operation, including grain refining aluminum on a continuous basis, the method comprising:

(a) providing a molten aluminum body;

(b) providing at least one metal from the group consisting of titanium, zirconium, vanadium, molybdenum, manganese, silicon, tungsten, tantalum, niobium and beryllium and mixtures thereof in said molten aluminum body in the range of 1 to 3000 ppm;

(c) adding to said molten aluminum body a material reactive with said metal, said material being in gaseous form and comprising at least one component of the group consisting of boron, carbon, sulfur, nitrogen and phosphorus, said material and said metal adapted for grain refining aluminum;

(d) maintaining said metal in stoichiometric excess of at least one of the group consisting of boron, sulfur, nitrogen and phosphorus; and (e) solidifying at least a portion of molten aluminum body to provide a grain refined, cast product.

26. The method in accordance with claim 25 including fluxing said molten aluminum body with a fluxing gas.

27. The method in accordance with claim 26 including adding said material reactive with said metal with said fluxing gas.

28. The method in accordance with claim 25 including dispersing said material reactive with said metal in said molten aluminum body using a carrier or fluxing gas.

29. The method in accordance with claim 25 including selecting said material reactive with said metal from at least one of the group consisting of $BCl_3$, $PCl_3$, $SF_6$, $KBF_4$, $BF_3$ and $NH_3$.

30. The method in accordance with claim 25 including selecting said material reactive with said metal from the group consisting of at least one of a chloride or fluoride of boron and phosphorus.

31. The method in accordance with claim 26 including forming a grain refiner in said molten aluminum having a particle size in the range of 0.05 to 2 $\mu$m.

32. A method of grain refining aluminum, the method comprising:

(a) providing a molten aluminum body;

(b) providing at least one metal selected from the group consisting of titanium, zirconium, vanadium, molybdenum, manganese, silicon, tungsten, tantalum, niobium and beryllium and mixtures thereof in said molten aluminum body;

(c) introducing to said molten aluminum body a material reactive with said metal, said material being in gaseous form and comprising at least one component of the group consisting of boron, carbon, sulfur, nitrogen and phosphorus; and (d) forming a grain refining compound comprised of said material and said metal in said molten aluminum body and casting a grain refined product.

33. The method in accordance with claim 32 wherein said metal is added concurrent with said material reactive with said metal.

34. A method of grain refining aluminum, the method comprising:

(a) providing a molten aluminum body in a temperature range of 1200° to 1500° F.;

(b) providing at least one metal selected from the group consisting of titanium, zirconium, vanadium, molybdenum, manganese, silicon, tungsten, tantalum, niobium and beryllium and mixtures thereof in said molten aluminum body;

(c) after providing said metal in said body, introducing to said body a material reactive with said metal, said material being in gaseous form and introduced to said body of molten aluminum in a carrier or fluxing gas, said material being a chloride or fluoride of one of the groups consisting of boron, carbon, sulfur, nitrogen and phosphorus; and (d) forming a grain refining compound comprised of said material and said metal in said molten aluminum body and casting a grain refined product.

35. A method of grain refining aluminum, the method comprising:

(a) providing a molten aluminum body;

(b) adding at least one metal selected from the group consisting of titanium, zirconium, vanadium, molybdenum, manganese, silicon, tungsten, tantalum, niobium and beryllium and mixtures thereof to said molten aluminum body in a range of 1 to 1500 ppm;

(c) after adding said metal, contacting said aluminum body with a material reactive with said metal, said material being in gaseous form and having a component thereof selected from at least one of the group consisting of boron, carbon, sulfur, nitrogen and phosphorus, said material and said metal adapted for grain refining said aluminum body;

(d) maintaining said metal in stoichiometric excess of at least one of the group consisting of boron, carbon, sulfur, nitrogen and phosphorus; and (e) forming a grain refining compound comprised of said material and said metal in said molten aluminum body and casting a grain refined product.

36. A method of grain refining aluminum, the method comprising:

(a) providing a molten aluminum body;

(b) providing 1 to 1500 ppm titanium in said molten aluminum body;

(c) introducing to said molten aluminum body a material reactive with said titanium, said material being in gaseous form at molten aluminum temperatures and comprising a carbon-containing material; and (d) forming a grain refining compound comprised of said material and said titanium in said molten aluminum body and casting a grain refined product.

37. The method in accordance with claim 36 wherein said carbon-containing material is selected from the group consisting of kerosene, carbon tetrachloride, vinyl chloride, polytetrafluorethylene, butane, freon and ethylene chloride.

38. A method of grain refining aluminum, the method comprising:

(a) providing a molten aluminum body in a temperature range of 1200° to 1500° F.;

(b) providing titanium in said molten aluminum body;

(c) after providing said titanium in said body, introducing to said body a material reactive with said titanium, said material being in gaseous form in said temperature range and introduced to said body of molten aluminum in a carrier or fluxing gas, said material being a chloride or fluoride of carbon; and (d) forming a grain refining compound comprised of said material and said titanium in said molten aluminum body and casting a grain refined product.

39. A method of grain refining aluminum, the method comprising:

(a) providing a molten aluminum body;

(b) adding a source of titanium to said molten aluminum body in a range of 1 to 1500 ppm;

(c) after adding said titanium, contacting said aluminum body with a material reactive with said titanium, said material being in gaseous form at molten aluminum temperatures and having a component thereof comprised of carbon, said material and said titanium adapted for grain refining said aluminum body;

(d) maintaining said titanium in stoichiometric excess of said carbon; and (e) forming a grain refining compound comprised of said carbon and said titanium in said molten aluminum body and casting a grain refined product.

40. The method in accordance with claim 39 wherein said carbon-containing material is selected from the group consisting of kerosene, carbon tetrachloride, vinyl chloride, polytetrafluorethylene, butane, freon and ethylene chloride.

41. An improved grain refined aluminum alloy cast product comprised of an aluminum alloy and grain refiner nuclei, the grain refiner nuclei comprised of:

a metal selected from the group consisting of titanium, niobium, tungsten, tantalum, vanadium, molybdenum, manganese, silicon, zirconium and beryllium or mixtures thereof and a material reactive with said metal in molten aluminum to form the grain refiner in situ, the material reactive with said metal comprised of at least one component selected from the group consisting of boron, carbon, sulfur, nitrogen and phosphorus, the grain refiner nuclei present in the cast product as discrete particles and having:

(i) a particle size in the range of 0.05 to 2 $\mu$m; and (ii) at least 70% of the grain refiner nuclei having a particle size in the range of 0.1 to 1 $\mu$m.

42. The improved grain refine- in accordance with claim 41 wherein said metal is titanium and said component is boron to form grain refining nuclei comprised of $TiB_2$.

43. An improved grain refined aluminum alloy cast product comprised of an aluminum alloy and grain refiner nuclei, the grain refiner nuclei comprised of:

titanium and a material reactive with said titanium in a molten aluminum to form a titanium based grain refiner in situ, the material reactive with titanium comprised of at least one component selected from the group consisting of boron, carbon, sulfur, nitrogen and phosphorus, the grain refiner nuclei present in the cast product as discrete particles and having:

(i) a particle size in the range of 0.05 to 2 $\mu$m; and (ii) at least 70% of the grain refiner nuclei having a particle size in the range of 0.1 to 1 $\mu$m.

44. The improved aluminum alloy cast product in accordance with claim 43 wherein the titanium based grain refiner includes a metal selected from the group consisting of niobium, tungsten, tantalum, vanadium, molybdenum, manganese, silicon, zirconium, aluminum and beryllium.

45. The improved aluminum alloy cast product in accordance with claim 43 wherein the titanium based grain refiner is comprised of at least 50% titanium.

46. The improved aluminum alloy cast product in accordance with claim 43 wherein the titanium based grain refiner is comprised of 1 to 30% of a metal selected from the group consisting of niobium, tungsten, tantalum, vanadium, molybdenum, manganese, silicon, zirconium and beryllium or mixtures thereof.

47. The improved aluminum alloy cast product in accordance with claim 43 wherein the titanium based grain refiner is comprised of 1 to 15% vanadium.

* * * * *